US006916297B2

(12) United States Patent
Hafemann

(10) Patent No.: US 6,916,297 B2
(45) Date of Patent: Jul. 12, 2005

(54) FOOT CARE APPARATUS AND ATTACHMENTS

(75) Inventor: Klaus Hafemann, Essen (DE)

(73) Assignee: Wik Far East Ltd., Hong Kong (CN)

( * ) Notice: Subject to any disclaimer, the term of this patent is extended or adjusted under 35 U.S.C. 154(b) by 156 days.

(21) Appl. No.: 10/184,475

(22) Filed: Jun. 28, 2002

(65) Prior Publication Data

US 2003/0004442 A1 Jan. 2, 2003

(30) Foreign Application Priority Data

Jun. 30, 2001 (DE) ..... 201 10 876 U

(51) Int. Cl.[7] ..... A61H 7/00; A61H 15/00

(52) U.S. Cl. ..... 601/27; 601/22; 601/102; 601/104; 601/112; 601/113; 601/136; 4/541.5

(58) Field of Search ..... 601/17, 19, 22, 601/27, 52, 67, 69, 70, 98, 102, 104, 112, 113, 114, 136, 158; 4/622, 541.5

(56) References Cited

U.S. PATENT DOCUMENTS

| | | | | | |
|---|---|---|---|---|---|
| 3,906,940 | A | * | 9/1975 | Kawada | 601/6 |
| 4,984,569 | A | * | 1/1991 | Liu | 601/93 |
| 5,558,625 | A | * | 9/1996 | McKay | 601/118 |
| 5,643,062 | A | | 7/1997 | Joseph et al. | |
| 5,803,916 | A | | 9/1998 | Kuznets et al. | |
| 5,910,123 | A | * | 6/1999 | Wang | 601/28 |
| 6,056,709 | A | * | 5/2000 | Hashimoto | 601/127 |
| 6,149,611 | A | * | 11/2000 | Chen | 601/22 |
| 6,385,795 | B1 | * | 5/2002 | Ferber et al. | 4/622 |
| 6,405,390 | B2 | | 6/2002 | Kuen | |
| 6,494,849 | B2 | * | 12/2002 | Kuo | 601/27 |
| 6,568,000 | B1 | | 5/2003 | Kaufman et al. | |
| 6,725,471 | B2 | | 4/2004 | Ferber et al. | |

FOREIGN PATENT DOCUMENTS

| | | |
|---|---|---|
| DE | 2932916 A1 | 3/1981 |
| DE | 295 02 720 U1 | 5/1996 |
| DE | 295 02 702 U1 | 7/1996 |
| DE | 201 12 359 U1 | 3/2002 |
| DE | 1 269 966 A3 | 6/2002 |
| WO | WO 98/27851 | 9/1998 |

* cited by examiner

*Primary Examiner*—Michael A. Brown
*Assistant Examiner*—Quang D. Thanh
(74) *Attorney, Agent, or Firm*—Margaret Polson; Patent Law Offices of Rick Martin, P.C.

(57) ABSTRACT

A care or treatment attachment for a foot care apparatus, comprising at least one movable care or treatment element as well as a coupling piece, with which the attachment can be connected to the movement of a motor-driven driving shaft 8 inside the foot care apparatus 6. The attachment comprises a housing which is secured in position on the housing so that driving movement transmitted from the driving shaft does not move the housing. A coupling piece is movable mounted in housing and is supported movably corresponding to the driving movement transmitted from driving shaft of the foot care apparatus. The coupling piece at the driven side drives a power converter for the conversion of the driving movement into a differing movement which powers the one or more movable care or treatment attachments.

6 Claims, 2 Drawing Sheets

FOOT CARE APPARATUS AND ATTACHMENTS

CROSS REFERENCE APPLICATIONS

This application claims priority from German application no. 201 10 876.3 filed Jun. 30, 2001.

FIELD OF INVENTION

The present invention relates to a care or treatment attachment for a foot care apparatus comprising at least one movable care or treatment element as well as a coupling piece with which the attachment can be connected to the movement of a motor-driven driving shaft of the foot care apparatus. The invention further relates to a foot care apparatus with a motor-driven driving shaft onto which a care or treatment attachment can be placed.

BACKGROUND OF THE INVENTION

A foot care apparatus with a care or treatment attachment which can be placed onto a driving shaft turned rotatably by a motor is known from DE 295 02 702 U1. It is also known to have foot care apparatus as part of a foot tub, divided by a center ridge into two sub areas. Each sub area of the foot tub serves for receiving one foot. The sub areas can have inserts resting on the tub bottom to a massage of the foot soles. The ridge dividing the foot tub forms at the under side a hollow volume, in which is contained an electromotor and further electric/electronic elements required for operating the foot care apparatus. The electromotor drives a driving shaft such that it rotates, which shaft is carried through the upper side of the ridge and supports at its upper termination a crosspiece as a coupling piece. This crosspiece serves as the attachment place for a care or treatment attachment, such that it is torsion-tight, onto the coupling piece of the driving shaft.

During operation of the electromotor the entire attachment is set into rotation according to the turning movement of the driving shaft. As various attachments are employed the user can move the foot to use the attachment on different areas of the foot. One type of attachment is one with several rollers supported movably such that during operation of such a roller through the turning movement of the attachment and the movable support of the rollers in the attachment the user can massage their foot. Other attachments known in the art is pumice stones for abrading calluses, brushes or the like, depending on the purpose to be served with such care or treatment attachments.

Conventionally such a foot care device is also equipped with a device for generating vibrations, in order to set into vibration the inserts in the tub sections in order to give an overall massage the soles of the feet. Generally the electromotor is driven independently of the vibration generation device and, in contrast to such foot care apparatus in which attachments are placed onto a vibration head covering the vibration generator, permits a considerably more specific care or treatment of individual foot regions, in particular also as it relates to treatment intensity. The known care or treatment attachments thus with their different embodiments have a rotary effect onto the particular desired foot region.

Even if, in principle, with such a known foot care apparatus satisfactory care or treatment results can be attained, it would be desirable if such care or treatment attachments were also available which have a different functionality.

Building on this discussed prior art, the invention therefore addresses the problem of providing an above-described care or treatment attachment for a foot care apparatus, whose functionality is fundamentally increased compared to the known ones.

The present invention has one or more attachments which have housing which is secured in position on a foot care apparatus. This means that the driving movement transmitted from the driving shaft of the electromotor onto the coupling piece does not move the housing. Rotatably mounted in the housing is coupling piece which moves corresponding to the driving movement of the driving shaft of the foot care apparatus. The coupling piece drives at the driven side a power converter for the conversion of the driving movement into a movement differing in one of its properties from the driving movement and powers one or several movable care or treatment elements driven by the power converter.

In contrast to the known prior art, in the present inventions the entire attachment is not moved. The housing is secured in position on the foot care apparatus such that the housing of the attachment is decoupled from the driving movement of the foot care apparatus. This opens the capability of placing a power converter in the housing, which can then convert the driving movement of the driving shaft into a number of different types of movement so that several specific care or treatment elements can be used.

The driving movement of the driving shaft, in principle, can be developed such that it is alternating translational or also rotational. The conversion by the power converter of a rotational turning movement of the driving shaft and the coupling piece of the attachment can serve for driving a drum supported horizontally with its rotational axis. The power converter can also be developed as an eccentric, through which a plate is set into vibration, wherein the vibration plane can extend perpendicularly to the rotational axis of the driving shaft. The vibration movement can have a rotational component or also be developed such that it is alternatingly translational. Apart from numerous other elements, as the power converter can also serve a cam disk with one or several positional cogs through which several massage push rods supported in the housing such that they are vertically movable, can be moved alternately and successively.

If a rotational turning movement of the driving shaft is provided, the housing of the attachment can, for example, be held torsion-tight by bars or pins projecting downwardly, which engage corresponding cutouts of the foot care apparatus.

SUMMARY OF THE INVENTION

The primary aspect of the present invention is to provide an improved foot care apparatus and attachments.

Other aspects of this invention will appear from the following description and appended claims, reference being made to the accompanying drawings forming a part of this specification wherein like reference characters designate corresponding parts in the several views.

A care or treatment attachment for a foot care apparatus, comprising at least one movable care or treatment element as well as a coupling piece, with which the attachment can be connected to the movement of a motor-driven driving shaft 8 inside the foot care apparatus 6 is disclosed. The attachment comprises a housing which is secured in position on the housing so that driving movement transmitted from the driving shaft does not move the housing. A coupling piece is movable mounted in housing and is supported movably corresponding to the driving movement transmitted from driving shaft of the foot care apparatus. The coupling piece at the driven side drives a power converter for the conversion of the driving movement into a differing movement which powers the one or more movable care or treatment attachments.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
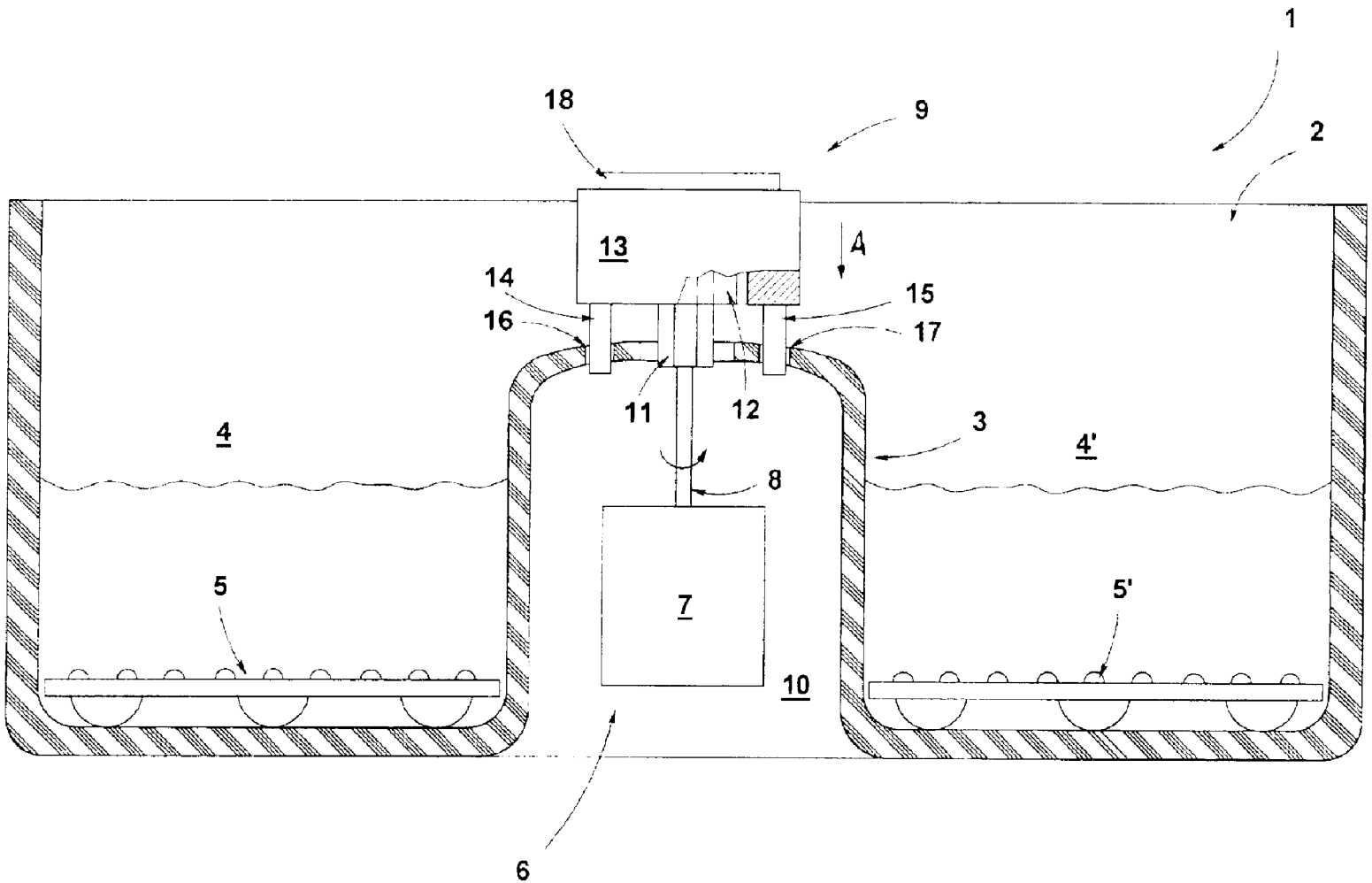
FIG. 1 is a schematic cross section through a foot care device of the present invention according to a first embodiment.

A foot care device 1 comprises a foot tub 2, which is divided into two subtubs 4, 4' by a ridge 3. As shown in FIG. 1, the subtubs 4, 4' can be filled with liquid. The bottom of the subtubs 4, 4' is conventionally covered with an insert 5, 5', which serves for massaging the soles of the feet of a user.

The ridge 3 supports a foot care system overall denoted by the reference number 6, which comprises an electromotor 7, a driving shaft 8 and a care or treatment attachment 9. For the sake of clarity, further required components, such as electric switches or the like are not shown. The electromotor 7 is fastened torsion-tight in the hollow volume 10 formed by ridge 3. At the upper end of the driving shaft 8 is disposed a crosspiece 11 as a coupling device, onto which the coupling piece 12 of the care or treatment attachment 9 can be placed such that it is torsion-tight. The care or treatment attachment 9 comprises a housing 13, which is secured torsion-tight in position on the ridge 3 via pins 14, 15, projecting downwardly and engaging corresponding cutouts 16, 17 of ridge 3 or other attachment mechanism known in the art. Within housing 13 the coupling piece 12 is supported corresponding to the rotational driving movement of the driving shaft 8.

The care or treatment attachment 9 supports a drum 18 whose rotational axis is disposed such that it extends horizontally. For converting the rotational turning movement of the coupling piece 12 with a vertical rotational axis into the rotational turning movement of the drum 18 a power converter $P_1$ is provided. Any of the known the art methods of converting rotational movement, for example two bevel gears meshing with each other at the front side, can be used in the present invention.

The care or treatment attachment 9 and coupling piece 12 is detachable from the driving shaft 8 or its crosspiece 11 and can readily be exchanged for another attachment. In FIG. 1 attachment 9 is shown in a non-operating position. To actuate attachment 9 and electromotor 7 the attachment 9 must be pressed downwardly according to the depicted direction of the arrow A, through which movement an electric contact is closed and the electromotor 7 is powered. The actuation can be accomplished with the foot to be treated. It is understood that the electromotor 7 can also be driven through a manual switch (not shown).

Figure 2:
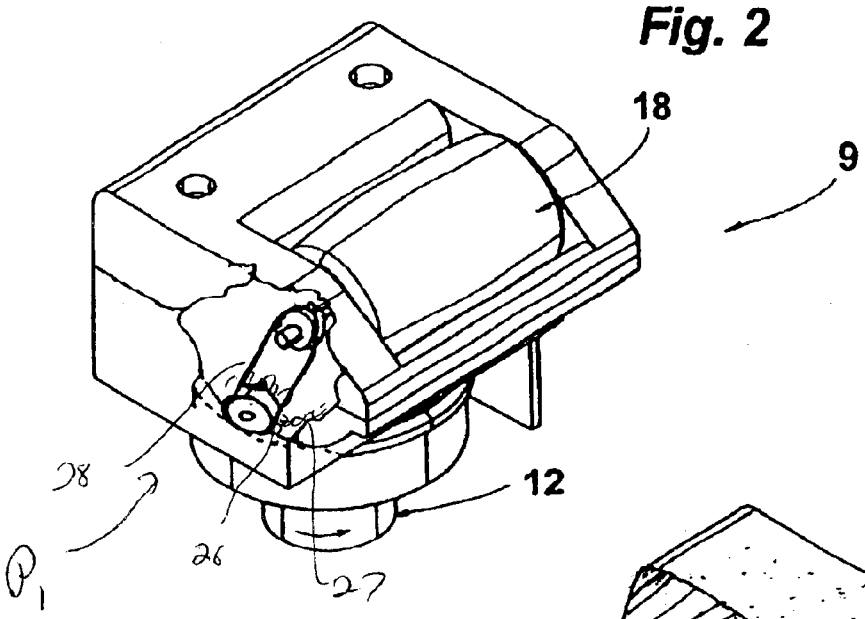
FIG. 2 is a perspective view of the care or treatment attachment of FIG. 1.

FIG. 2 shows the attachment 9 with its drum 18 on an enlarged scale. The directions of movement of the coupling piece 12 and of the drum 18 are therein again identified with arrows B and C respectively. The power converter $P_1$ has two bevel gears 26, 27 operating in a known manner in the depicted embodiment. A ribbon or chain 28 then transfers the movement from the gear to the drum 18.

Figure 3:
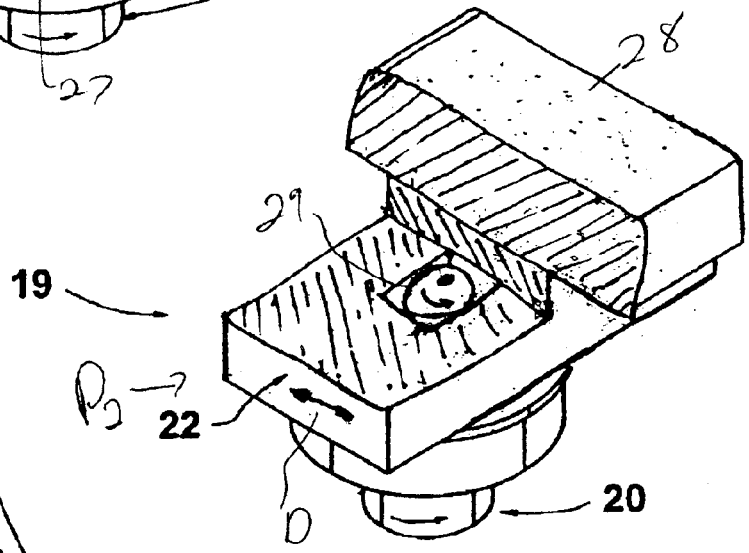
FIG. 3 is a perspective view of an alternate embodiment of a care or treatment attachment.

FIG. 3 shows a further care or treatment attachment 19 whose coupling piece 20 can also be driven rotationally. As the care or treatment element in the attachment 19 has a plate 21 provided with a sandpaper-like granulation, which can be set into movement through a power converter $P_2$ disposed in housing 22 of attachment 19. The power converter $P_2$ is an eccentric 29, through which the plate 21 is set into an alternatingly translational movement—as indicated by the double arrow D.

Figure 4:
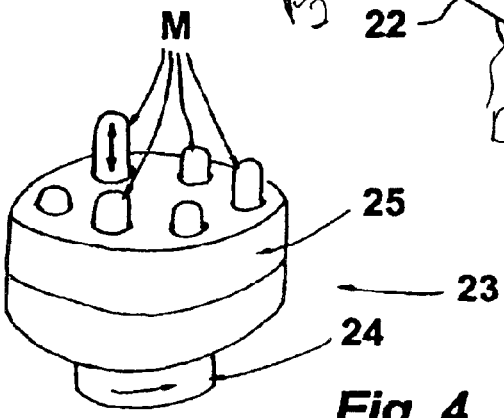
FIG. 4 is a schematic perspective view a care or treatment attachment of another alternate embodiment.

A further care or treatment attachment 23 is shown in FIG. 4, whose rotationally driven coupling piece 24 drives a cam disk (not shown) with one or more positional cogs disposed in housing 25. On the topside of the cam disk reside six massage push rods M, which, according to the disposition of the positional cogs on the cam disk, during a rotational turning movement of the coupling piece 24 and corresponding to the cam disk are alternately raised for massaging as is known in the art.

The description of the invention makes clear that with the care or treatment attachments according to the invention a multiplicity of attachments, in particular markedly differing from one another in terms of their functionality, is possible, allowing a variety of specific care or treatments can be carried out. Especially useful is the application of such care or treatment attachments for foot care apparatus, which are part of a foot care device with a tub, since in this case all elements are combined in a single foot care device. However, in principle the foot care apparatus can also be employed individually and independently of a relatively large foot care device.

Although the present invention has been described with reference to preferred embodiments, numerous modifications and variations can be made and still the result will come within the scope of the invention. No limitation with respect to the specific embodiments disclosed herein is intended or should be inferred.

List of Reference Symbols

1 Foot care device
2 Foot tub
3 Ridge
4, 4' Subtub
5, 5' Insert
6 Foot care apparatus
7 Electromotor
8 Driving shaft
9 Care or treatment attachment
10 Hollow volume
11 Crosspiece
12 Coupling piece
13 Housing
14 Pin
15 Pin
16 Cutout
17 Cutout
18 Drum
19 Care or treatment attachment
20 Coupling piece
21 Plate
22 Housing
23 Care or treatment attachment

24 Coupling piece
25 Housing
M Massage push rods

I claim:

1. A combination of a foot care apparatus having a motor-driven driving shaft and a care or treatment attachment mountable on and driven by the driving shaft, said care or treatment attachment comprises:

a housing secured in position on foot care apparatus and being decoupled from the driving movement of the driving shaft;

a coupling piece rotably mounted within the housing connected to the motor-driven shaft of the foot care apparatus and being turned within the housing by the motion of the driving shaft;

at least one care or treatment element movably mounted to the care or treatment attachment;

a power converter mounted inside the housing and driven by the coupling piece and powering the at least one care or treatment element, converting the rotating motion of the coupling piece into the intended movement of the at least one care or treatment element, said movement of the at least one care or treatment element differs from the rotating motion of the coupling piece in respect to the orientation of its axis of movement.

2. The attachment of claim 1 wherein the coupling piece is rotatably supported in the housing of the attachment.

3. The attachment of claim 2, wherein the power converter changes the rotational turning movement of the coupling piece, having rotational axis which is substantially vertical, into a rotational turning movement of a drum serving as care or treatment element having a horizontal rotational axis.

4. The attachment of claim 2, wherein the power converter functions to convert of the rotational turning movement of the coupling piece into an alternatingly translational movement.

5. The attachment of claim 4, wherein the power converter further comprises a cam disk with one or several positional cogs, through which several massage push rods are alternatingly moves serving as care or treatment elements.

6. The attachment of claims 2, 3, 4 or 5, further comprises an attachment mechanism having:

bars or pins projecting downward from the housing; and corresponding cutouts on the surface of the foot care apparatus.

* * * * *